United States Patent [19]

Crowell et al.

[11] 3,942,543

[45] Mar. 9, 1976

[54] CHANGE MECHANISM FOR A GASOLINE DISPENSE OR THE LIKE

[75] Inventors: Lee Tyler Crowell, Whittier; Robert C. Greenwood, Cypress; Thomas E. Jones, Costa Mesa, all of Calif.

[73] Assignee: Pan Nova, Inc., Santa Fe Springs, Calif.

[22] Filed: June 17, 1974

[21] Appl. No.: 479,660

[52] U.S. Cl. ..... 133/2

[51] Int. Cl.[2] ..... G07D 1/06

[58] Field of Search ..... 133/4 A, 2; 194/10; 232/64; 206/.83, .84

[56] References Cited

UNITED STATES PATENTS

| | | | |
|---|---|---|---|
| 2,804,197 | 8/1957 | Popkess et al. | 206/.83 |
| 3,080,035 | 3/1963 | Diaz | 194/10 |
| 3,120,324 | 2/1964 | Amberg et al. | 221/282 X |
| 3,220,530 | 11/1965 | Offutt | 194/10 |
| 3,690,332 | 9/1972 | Dykehouse et al. | 133/4 A |

*Primary Examiner*—Stanley H. Tollberg
*Attorney, Agent, or Firm*—Harris, Kern, Wallen & Tinsley

[57] ABSTRACT

A change mechanism for a gasoline dispenser or the like for receiving coins or tokens and returning coins as change. A removable coin cartridge having provision for receiving incoming coins and paying out coins as change, and incorporating coin troughs as structural members of the cartridge. An installation configuration for permitting removal of an exhausted cartridge and insertion of a full cartridge at the dispenser, and reloading of cartridges at a remote location.

8 Claims, 6 Drawing Figures

CHANGE MECHANISM FOR A GASOLINE DISPENSE OR THE LIKE

This invention relates to coin operated devices, such as gasoline dispensers and the like, and in particular to a new and improved change mechanism. While the word "coin" is used throughout this specification and claims, it should be understood that the apparatus is suitable for use with tokens and other similar items and that the word coin is intended to include such other items.

In a typical coin operated dispenser, the customer deposits one or more coins into a coin acceptance mechanism. If the coins are acceptable, they are passed to a coin receiving container within the dispenser for subsequent collection by the operator. Product is then dispensed and if change is due the customer at the end of the product dispensing cycle, one or more coins, usually of various demonimations, will be paid out to the customer. Prior art dispensers utilizing change mechanisms are shown in U.S. Pat. Nos. 3,550,743; 3,605,973; 3,666,928; and 3,731,777; and in copending application Ser. NO. 427,579, filed Dec. 26, 1973 and assigned to the same assignee as the present application.

It is an object of the invention to provide a separate coin cartridge that can be loaded with coins at a remote location, carried to the dispenser and substituted for a spent cartridge in a simple operation requiring minimal down time for the dispenser. A further object is to provide such a cartridge which can incorporate a receptacle for the incoming coins.

It is another object of the invention to provide a new and improved coin cartridge with the coin carriers forming structural portions of the cartridge. An additional object is to provide such a coin cartridge with a unitary side member having a corragated configuration defining troughs for the coins, with a hinged or otherwise movable cover providing access for ease of loading.

It is a particular object of the invention to provide a change mechanism suitable for utilization in a dual gasoline dispenser which provides two gasoline pumping operations from a single housing, together with the necessary coin receiving and dispensing, metering, computation, indication and control for each of the two dispensing operations.

Other objects, advantages, features and results will more fully appear in the course of the following description. The drawings merely show and the description merely describes a preferred embodiment of the present invention which is given by way of illustration or example.

Figure 1:
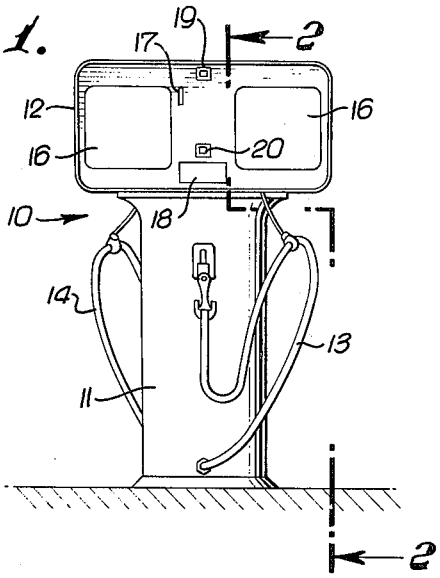
FIG. 1 is a front view of a coin operated gasoline dispenser incorporating the presently preferred embodiment of the invention.

The gasoline dispenser of FIG. 1 includes a housing 10 with a lower section 11 and an upper section 12. The piping, metering and valving is positioned in the lower section, with the computation and indicating equipment and the change mechanism in the upper section. The dispenser of FIG. 1 provides for two dispensing operations simulataneously through hoses 13 and 14. The face of the upper housing section 12 seen in FIG. 1 functions with the hose 13, while a similar face at the back functions with the hose 14.

The price per gallon, the number of gallons dispensed, the dollar amount paid for, the dollar amount dispensed, and other information may be displayed at panels 16. Coins are deposited by the customer at slot 17 and change is returned at opening 18. The dispensing operation may be initiated by the start button 19 and terminated by the stop buttom 20.

Figure 2:
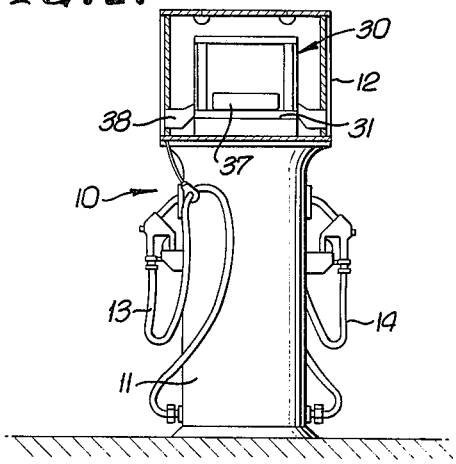
FIG. 2 is a sectional view taken along the line 2—2 of FIG. 1.
Figure 4:
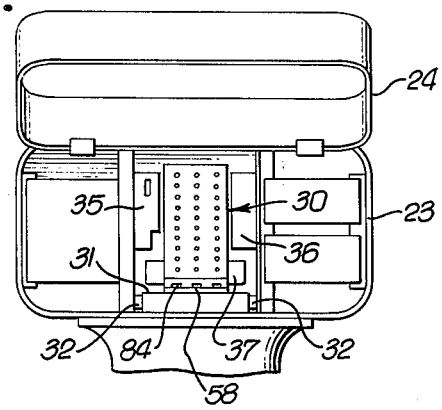
FIG. 4 is an enlarged partial view of the dispenser of FIG. 1 with a portion of the housing in the open position.

The upper housing section 12 has a central shell 23 and hinged covers 24, 25. A coin cartridge 30 is carried on a deck 31 mounted on a slide mechanism 32 in the shell 23. The deck 31 with the coin cartridge 30 is shown in the normal position within the housing in FIG. 2, and in the extended position in FIGS. 3 and 6. A coin acceptance mechanism 35 is mounted in the shell 23 with a coin receiving slot in line with the slot 17 of the hinged cover 24. Another coin acceptance mechanism 36 is mounted in the shell with a coin receiving slot in line with the slot in the other hinged cover 25. In the preferred embodiment illustrated, the coin acceptance mechanisms 35, 36 are mounted with a space therebetween for receiving the coin cartridge 30, as shown in FIG. 4. Each coin acceptance mechanism has two outlet passages, one directing valid coins into a tray 37 carried by the coin cartridge, and the other directing rejected coins to the coin return opening 18 via coin receptacle 38 carried on the hinged cover. The change mechanism when actuated, deposits the appropriate coins from the coin cartridge into the receptacle 38 for removal by the customer.

Figure 5:
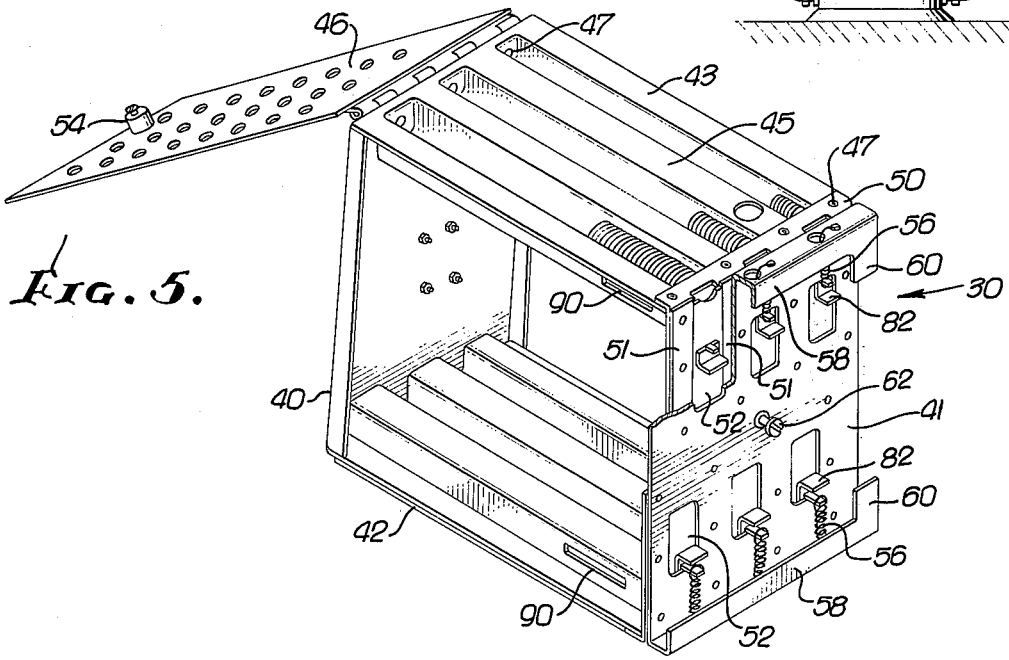
FIG. 5 is an isometric view of a coin cartridge from the dispenser of FIG. 1, with the cartridge lying on its side showing the coin loading configuration.
Figure 6:
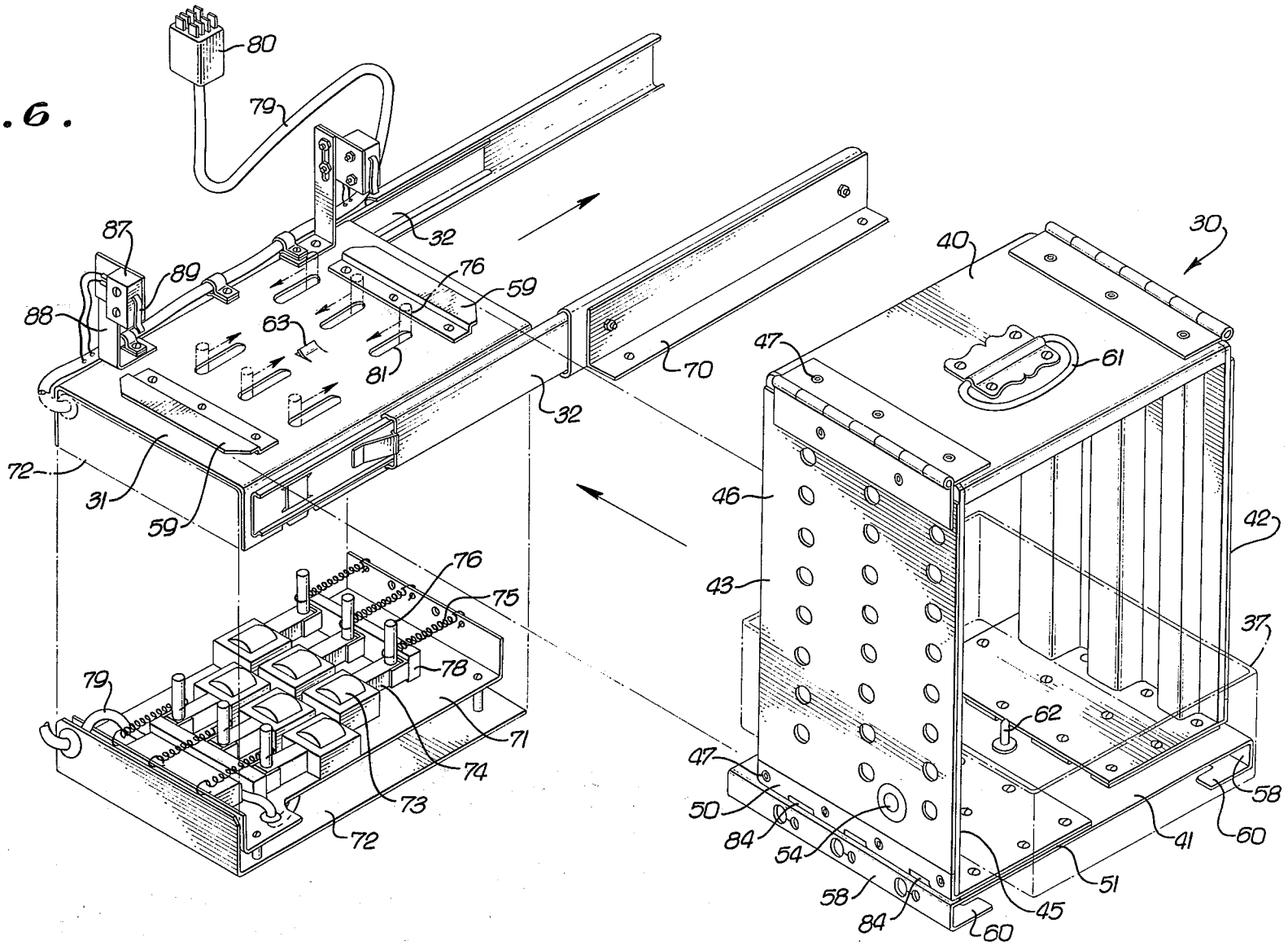
FIG. 6 is an exploded view illustrating the mounting of a coin cartridge in the housing of the dispenser.

The coin cartridge 30 is best seen in FIGS. 5 and 6, and comprises a frame with top 40, bottom 41, and sides 42, 43. The sides function as the coin carriers and are mirror images of each other and only one will be described in detail.

The side 43 includes a trough member 45 and a hinged cover 46. The trough member 45 preferably is a unitary molded plastic piece of corrugated configuration, providing a plurality of troughs for receiving coins. The trough member preferably is of a clear material providing immediate visual indication of the supply of coins. The member 45 may be attached to the top 40 and the hinge for the cover 46 by fasteners indicated at 47.

The lower end of member 45 may be attached to an angle bracket 50 which in turn is fixed to the bottom 41 with spacer plates 51 therebetween, providing space for slide plates 52.

The open coin troughs in the member 45 are closed by the cover 46 which may have a fastener 54 for engaging a mating component in the member 45.

A slide plate 54 is provided for each coin trough and operates in the conventional manner to move a coin outward from the bottom of the trough with each reciprocation of the slide plate. In the embodiment illustrated, the slide plate 52 is urged to the position shown in FIG. 5 closing the lower end of the coin trough by a spring 56 mounted between a tab on the slide plate 52 and an opening in the bottom 41.

Channels 58 are provided at opposite ends of the bottom 41 for sliding engagement with mating brackets 59 on the deck 31, with projecting portions 60 serving as stops. A handle 61 may be provided on the top 40 for carrying the coin cartridge, as a loaded coin cartridge is quite heavy. A lock pin 62 may be positioned in the bottom 41 for engaging a tab 63 in the deck 31 to maintain the coin cartridge in position on the deck.

In use, the coin cartridge is placed on its side as illustrated in FIG. 5 and the cover is opened. Coins of appropriate values are inserted in the open troughs, and the cover is then closed and latched. The unit is turned over and the second set of coin troughs is loaded in the same manner. The coin cartridge is now ready for carrying to the dispenser and mounting on the deck 31 by sliding the channels 58 under the brackets 59, as best seen in FIG. 6.

The slide mechanism 32 is mounted in the shell 23 of the housing upper section 12 by brackets 70. Actuators for the slide plates 52 of a coin cartridge are carried on a channel 71 mounted on a bottom plate 72 which is affixed to the lower side of the deck 31. In the preferred embodiment illustrated, each actuator is a solenoid comprising a coil 73 and a plunger 74, with the plunger being urged to the extended position by a spring 75 engaging a pin 76 of the plunger and an opening in the channel 71. Blocks 78 carried on a channel 71 serve as limit stops for the plungers. The electrical wiring for the solenoids is in the space between the channel 71 and plate 72 and is formed into a cable 79 having a plug 80 for connection with the remainder of the circuitry. This configuration permits all of the actuators to be assembled as a separate module on the plate 72, which is easily installed and removed from the deck 31. The pins 76 of the actuators project through slots 81 in the deck 31 for engagement with brackets 82 of the slide plates 52. When a solenoid coil 73 is energized, the plunger 74 is pulled into the coil against the urging of the spring 75. This brings the pin 76 into engagement with the bracket 82 of the corresponding slide plate, moving the slide plate toward the center of the coin cartridge against the urging of the spring 56. This permits a coin to move down onto the bottom 41 between the spacers 51. When the coil is deenergized, the springs 75, 56 return the plunger and slide plate to the positions shown in FIGS. 5 and 6, with the slide plate engaging the coin and pushing it out through the slot 84, and the coin drops into the receptacle 38 for retrieval by the customer.

Means are provided for determing when the supply of coins in a coin cartridge is low. This indication may be used to provide an indication to the operator and/or to prevent the gasoline dispenser from starting another dispensing cycle. In the embodiment illustrated, a microswitch 87 is mounted on a bracket 88 on the deck 31, with the microswitch actuator arm 89 projecting into a slot 90 in a coin trough of the coin cartridge. When there are coins in the trough as high as the arm 89, the switch will be in one condition; when the supply of coins falls below the arm 89, the switch will change to the opposite condition providing a signal to the dispenser circuitry. Position adjustment slots may be provided in the bracket 88 and in the switch 87 for locating the switch member 89 at the desired position.

Figure 3:
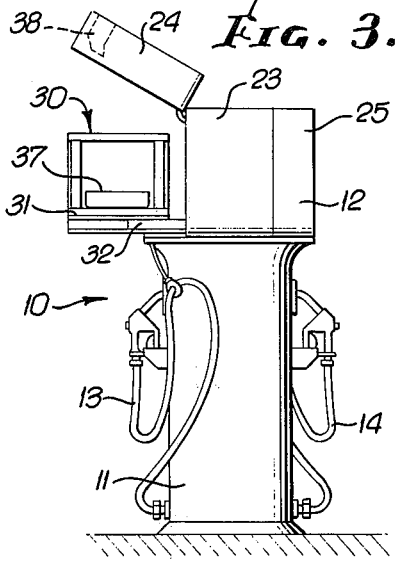
FIG. 3 is a view similar to that of FIG. 2 showing a portion of the dispenser in the open position with the change mechanism in the extended position.

When the operator desires to change a coin cartridge, he brings a loaded cartridge to the dispenser, opens the hinged cover and pulls the deck to the extended position of FIG. 3. He may empty the contents of the tray 37 into a bag or may leave it in the cartridge, which is then removed from the deck. The new cartridge is inserted, the deck is pushed into the housing and the cover is closed. The dispenser is again ready for use. The particular coin cartridge illustrated has three coin troughs for each side providing storage of quarters, nickels and pennies, with a capacity of $50.00 per side. Of course the number of different coins, the denominations, and the total quantity may be changed as desired. The clear plastic trough members 45 and the perforated covers 46 permits immediate visual determination of the coin supply by merely raising the housing cover. While the change mechanism has been described herein as used in a gasoline dispenser, it is understood that the change mechanism and the coin cartridge are not limited to this particular end use and may be utilized with any change making operation.

We claim:

1. In a change mechanism for a dispenser or the like, the combination of:

a housing having first and second opposite faces with a coin receiving opening and a coin return opening at each face;

first and second coin acceptance mechanisms mounted in said housing for receiving coins through said first and second face coin receiving openings, respectively;

a deck slideably mounted in said housing for movement into and out of said housing;

a coin cartridge removably mounted on said deck and having spaced first and second sets of coin carriers, said deck including means for moving coins from said first and second sets of carriers into said first and second face coin return openings, respectively; and a coin tray carried in said coin cartridge between said sets of coin carriers for receiving coins from said coin acceptance mechanisms.

2. A change mechanism as defined in claim 1 wherein each of said sets of coin carriers comprises a side of said coin cartridge and having a first member fixed between the cartridge top and bottom with a plurality of coin troughs in parallel, and a movable cover overlying the troughs.

3. A change mechanism as defined in claim 1, wherein said coin cartridge includes a frame having bottom, sides and top, with said sides spaced from each other and supporting said bottom from said top.

one of said sides comprising a first member fixed between said top and bottom and having a plurality of coin troughs in parallel with open edges for lateral movement of coins into said troughs, and a movable cover overlying said troughs and closing said open edges, said bottom including a plurality of slide plates at the lower ends of said troughs, with reciprocation of a slide plate moving a coin outward from a trough.

4. A change mechanism as defined in claim 1 wherein said coin cartridge includes:

a deck;

means for removably mounting said frame on said deck; and a plurality of actuators mounted in said deck, each of said actuators including a member engageable with a corresponding slide plate in the cartridge bottom for moving the slide plate.

5. A change mechanism as defined in claim 4 wherein said means for mounting includes interengageable members on said frame and deck for sliding said frame onto and off of said deck.

6. A change mechanism as defined in claim 5 wherein said coin cartridge includes second means for mounting said deck in a housing, said second means including means for supporting said deck and frame in a first position within the housing and in a second position projecting from the housing permitting sliding of said frame from said deck.

7. A change mechanism as defined in claim 3 wherein said frame has two opposite sides, each comprising a first member fixed between said top and bottom and having a plurality of troughs in parallel, and a movable cover overlying said troughs, with said troughs opening outward.

8. A change mechanism as defined in claim 7 wherein said coin cartridge includes a coin receiving tray on said deck between said opposite sides.

* * * * *

UNITED STATES PATENT OFFICE

CERTIFICATE OF CORRECTION

Patent No. 3,942,543 Dated March 9, 1976

Inventor(s) Lee Tyler Crowell et al.

It is certified that error appears in the above-identified patent and that said Letters Patent are hereby corrected as shown below:

Column 2, line 66, "54" should read -- 52 --.

Column 4, line 54, "top." should read -- top, --.

Column 4, line 64, "claim 1" should read -- claim 3 --.

Signed and Sealed this

Fifth Day of October 1976

[SEAL]

*Attest:*

RUTH C. MASON
*Attesting Officer*

C. MARSHALL DANN
*Commissioner of Patents and Trademarks*